United States Patent [19]

Görlitz et al.

[11] Patent Number: 4,978,011

[45] Date of Patent: Dec. 18, 1990

[54] SORTING MACHINE FOR GRAINED PRODUCTS

[75] Inventors: Frank-Otto Görlitz; Friedrich-Wilhelm Rüsch, both of Braunschweig, Fed. Rep. of Germany

[73] Assignee: Bühler GmbH, Braunschweig, Fed. Rep. of Germany

[21] Appl. No.: 196,382

[22] Filed: May 19, 1988

[30] Foreign Application Priority Data

May 19, 1987 [DE] Fed. Rep. of Germany ..... 3716664

[51] Int. Cl.[5] ..... B07C 9/00; B07B 13/10

[52] U.S. Cl. ..... 209/694; 209/480; 209/691; 209/504; 209/508

[58] Field of Search ..... 209/691, 694, 695, 696, 209/699, 700, 707, 479–481, 504, 508; 74/61, 87

[56] References Cited

U.S. PATENT DOCUMENTS

| | | | |
|---|---|---|---|
| 2,403,502 | 7/1946 | Cook | 74/61 |
| 2,429,543 | 10/1947 | Bastanchury | 209/480 |
| 2,481,174 | 9/1949 | Strawn | 74/87 |
| 2,695,523 | 11/1954 | Oswalt | 74/61 |
| 2,958,421 | 11/1960 | Kleiser | 209/480 |
| 2,989,869 | 6/1961 | Hanggi | 74/61 |
| 3,339,422 | 9/1967 | Petrin | 74/87 |
| 3,342,075 | 9/1967 | Lowe | 74/87 X |
| 3,407,670 | 10/1968 | Venanzetti | 74/61 |
| 3,473,657 | 10/1969 | Graf et al. | 209/694 |
| 3,822,604 | 7/1974 | Grimmer | 74/87 |
| 3,926,793 | 12/1975 | Wise | 209/504 X |
| 4,026,828 | 5/1977 | Smiley . | |
| 4,078,996 | 3/1978 | Cohen-Alloro et al. | 209/504 X |
| 4,196,637 | 4/1980 | Barrot et al. | 74/61 |
| 4,341,126 | 7/1982 | Thomas | 74/61 |
| 4,580,456 | 4/1986 | Takano | 74/87 |
| 4,722,446 | 2/1988 | Satake | 209/694 |
| 4,771,894 | 9/1988 | Lapp | 209/694 X |
| 4,795,552 | 1/1989 | Yun et al. | 209/366.5 X |

FOREIGN PATENT DOCUMENTS

| | | | |
|---|---|---|---|
| 1241242 | 5/1967 | Fed. Rep. of Germany . | |
| 3507073 | 11/1985 | Fed. Rep. of Germany . | |
| 1233965 | 5/1986 | U.S.S.R. | 209/691 |
| 0719939 | 12/1954 | United Kingdom | 209/480 |
| 0898209 | 6/1962 | United Kingdom . | |
| 2157979 | 11/1985 | United Kingdom . | |

*Primary Examiner*—Margaret A. Focarino
*Assistant Examiner*—Edward M. Wacyra
*Attorney, Agent, or Firm*—Michael J. Striker

[57] ABSTRACT

A sorting machine for grained products comprises at least one sorting board which is inclined relative to horizontal and vertical planes and reciprocatingly vibratable in a plane and direction suitable for sorting, a unit for supplying a product to be sorted and arranged in one region of the sorting board and a unit for separating and withdrawing a sorted product and located in another region of the sorting board, the sorting board with the supplying unit and the separating and withdrawing unit together forming a sorting unit, two imbalance drives which operate in opposite directions and cooperate with the sorting unit for driving the latter in vibration, a base frame, a unit forming at least three supporting points on which the sorting unit is supported in a vibration-damping manner freely movably so as to provide inclination of the sorting unit relative to horizontal and vertical planes, and a unit for additionally adjusting the inclination relative to the horizontal and vertical planes.

13 Claims, 8 Drawing Sheets

SORTING MACHINE FOR GRAINED PRODUCTS

BACKGROUND OF THE INVENTION

The present invention relates to a sorting machine for grain products More particularly, it relates to such a sorting machine which has at least one sorting board arranged in an inclined fashion relative to the horizontal and vertical planes and driven in a reciprocating vibration in a plane which is suitable for sorting.

Sorting machines of the above mentioned general type are known in the art. One of such sorting machines is disclosed, for example, in the German document DE-AS 1,241,242. In this sorting machine the sorting board is provided with a rough upper surface which is favorable for separating of particles of a product to be sorted into separate streams. A supply unit for supplying a product to the sorting board is arranged in a highest region of the sorting board or the sorting boards, while a separating and withdrawing unit for the individual product fractions is arranged approximately in the region of the lowest corner of the sorting board or the sorting boards. The sorting board or boards together with the supply unit and/or separating and withdrawing units are assembled in a single sorting unit.

Under the action of the roughness and the oscillating movement of the sorting board the particles of the product are subjected to accelerations which result in a throwing movement. Because of the different specific weight or, in accordance with a new understanding of the process, the different sliding properties of the individual particles of the product, as well as the spatially inclined arrangement of the sorting board, several withdrawing streams which are separate from one another are formed with desired product fractions.

The above mentioned German document DE-AS 1,241,242 also discloses a sorting machine in which a co-oscillating supplying device is provided since it operates only with one sorting plate, and the product is fed in the region of the center of the upper longitudinal edge of the sorting plate. A somewhat different construction of the withdrawing region is provided, in that it has lateral product withdrawing troughs. For vibration of the sorting plate, a mechanically expensive construction is provided with a supporting frame for inclining the plate, and the supporting plate is articulately mounted on a base plate by means of two link pairs and oscillated by means of an outwardly engaging eccentric drive. Because of this construction, the eccentric drive must move considerable masses, which leads to a premature wear and application of considerable reaction forces to the base plate or the ground which supports the machine. Also, the possible oscillation frequency is limited by the relatively high mass forces. Finally, an additional inclination adjustment of the whole structure on a support frame and sorting plate by lifting or lowering of the foot point of the link pairs which lie farthest from the eccentric drive is provided. These foot points take up static and dynamic forces which additionally load the adjusting drive. In addition, this inclination adjustment acts substantially in the region of the upper reversing point of the sorting plate and therefore is limited to the change of only one inclination plane of the plate, which substantially limits the adjustment to different products to be sorted.

Another sorting machine is disclosed in the German document DE-OS 3,507,073. In this grain product sorting machine, a certain adjustment of the above described machine to modern conventional outputs is provided, however, with relatively high expenses. In addition to the fact that the sorting plates are assembled in stacks and a suppporting frame with links in the sense of the DE-AS 1,241,242 is no longer provided, the known grained product sorting machine also has an eccentric drive which is connected especially in highly oscillating units or sieve stacks, with mass forces of considerable magnitude. These forces are transferred to the complicated base frame provided for this reason with numerous reinforcements and also to the planes of installment and its environment in a disturbing manner. Further, the eccentric drive possesses the disadvantages in that it is subjected to mechanical wear and requires the maintenance. Furthermore, for force transmission of the eccentric drive and for supporting through expensive supporting units extending partially upwardly and downwardly in the base frame, the sieve stack is surrounded by U-profiles in a cage-like manner. The U-profiles are fixedly screwed with each individual sorting plate, so that a plate exchange for example in connection with an exchange of the product to be sorted or renovation, can be dismounted only with considerable mounting expenses. Finally, this machine is provided with additional inclination adjustment of the sieve stack only about one axis, and the adjusting device provided with numerous levers, links and threaded spindles is acted by the swinging units or the sieve stack not in exactly advantageous manner. Also, the accessability of the associated adjusting wheels is not optimal.

SUMMARY OF THE INVENTION

Accordingly, it is an object of the present invention to provide a sorting machine for grained products which avoids the disadvantages of the prior art.

More particularly, it is an object of the present invention to provide a sorting machine for grained products which is free from numerous shortcomings, has a simple and clear concept, and is price favorable, and further such a sorting machine which is subjected to approximately no mechanical wear, is correspondingly maintenance free and operates with small mass forces.

Also, it is an object of the present invention to provide such a sorting machine which is accessible from all sides, is not surrounded by a base frame or the like, has a small base surface, and can be easily adjustable to the requirements of different sorting products.

In keeping with these objects and with others which will become apparent hereinafter, one feature of the present invention resides, briefly stated, in a sorting machine in which a sorting unit is subjected to vibration by associated oppositely rotating imbalance drives, and is positioned in freely movable manner on at least three supporting points with interposition of vibration-damping elements on a base frame which provides inclinations of the sorting unit relative to a horizontal plane and relative to a vertical plane, and the machine has means for additional adjustment of these both inclinations.

When the sorting machine is designed in accordance with the present invention and utilizes the imbalance drives, expensive mechanical means with eccentrics, coupling rods, etc. are avoided, and the opposite running of these drives leads to a compensation of the imbalance actions so that the sorting unit is reciprocatable only in one direction. Thereby, a freely movable positioning of the sorting unit on the base frame and therefore an all-sided accessability of the machine is possible with the further advantage in that the means for additional inclination adjustment especially in two planes does not have to be arranged in an expensive manner on the oscillating parts of the machine, but instead can be provided in the stationary base frame.

In a simple manner, the sorting operation of the machine is assured by the pure arrangement of the imbalance drives, in that they are adjustable as to their operation and arranged so that the vibration movement extends substantially perpendicular to the line of gravity of the sorting unit and in a plane which is inclined steeper to the vertical plane than the plane of the sorting board or the sorting boards.

The imbalance drives which are formed as oppositely running self-synchronizing exciters of circular movement provide for an advantageous and price-favorable solution, since they are conventional aggregates.

Though the sorting characteristic of the machine can be changed by changing the vibration frequency or in other words by the number of revolutions of the imbalance drives within certain limits, it is also possible that for special products it is necessary to increase the oscillating stroke of the sorting unit or the sorting board. In accordance with an advantageous further embodiment of the invention, the imbalance weights are arranged on the drive shafts of the imbalance drives in radially displaceable manner to achieve this goal. An advantageous, automatic control of the stroke by a simple rotary speed change of the imbalance drives is provided when the radial displacement is performed automatically in dependence on the number of revolutions against a spring or weight force.

In accordance with a further embodiment of the invention, several sorting boards are arranged over one another in form of a stack and in the region of their edges located near the supplying unit and the separating and withdrawing unit are clamped between two upper and lower traverses by means of releasable clamping elements. Such a construction provides for the fixed clamping and very simple exchange of the sorting boards with minimal material and labor expenses, which are incomparable for example with the known screwing of the sorting boards by means of a plurality of U-shaped profiles.

In accordance with an advantageous embodiment of the invention, the supporting points are arranged on the lower traverses, and the lower traverses are connected by means of a stable, elongated supporting member, while an upper elongated supporting member which extends parallel to the lower elongated supporting member passes through the upper traverses so that the upper traverses are supported and fixed on it. The fixation can be performed for example by a simple eccentric displacement by means of a lever.

A fixed connection for the whole sorting unit is performed in a simple manner when all elongated supporting members extend laterally outwardly beyond the traverses and also beyond the separating and withdrawing unit and connected at their ends by respective end plates. For performing the vibration movement in the thus made unit, it is advantageous when one imbalance drive is arranged on each end plate.

The end plates located on the opposite sides are suitable also for a further advantageous use. Since both the supplying unit and the separating and withdrawing unit are assembled with the sorting boards to make a single sorting unit, there is a small sealing problem between the sorting boards on the one hand, and these arrangements on the other hand. This situation can be improved at the supply side in a simple manner by arranging a pressing traverse which is adjustably supported in the supply-side end plate, engages all sorting boards and acts in direction towards the separating and withdrawing unit. This support and adjustment can be performed for example by means of screws which are accessible from the outer side of the end plate.

As mentioned above, in accordance with the concept of the inventive sorting machine, means are provided for additional inclination adjustment of the sorting unit in the stationary base frame. Thereby the adjusting devices which co-vibrate can be dispensed with. This is especially advantageous in the event of such inclination adjustments in two planes in view of the mechanical complexity of respective adjusting devices.

To provide a simple sorting machine with a nice shape, the base frame which supports the sorting unit includes a horizontal substantially T-shaped member which in the region of its ends has a plurality of support extending in direction toward the supporting points and having different lengths. The base frame is arranged on a bottom structure which is adjustable relative to horizontal and vertical planes and formed as a Cardan support. The supports provide for a coarse inclination of the sorting unit relative to horizontal and vertical planes, while the additional fine adjustment is performed by the bottom structure. For a further advantageous simplification, it is possible to dispense with the bottom structure and to make at least two of the supports adjustable in a longitudinal direction.

In both cases a finely shaped, simple and aesthetically determined design of the inventive sorting machine is obtained when the machine has three such supports. The longitudinal adjustability of the supports can be performed by mechanical adjusting spindles or hydraulic or pneumatic piston-cylinder units. They can be actuated from outside by manual operation and automatically in dependence upon the parameters of the sorted product fractions detected by sensors.

In accordance with a further embodiment of the invention for providing a high bending strength and weight economy, each sorting board is formed as a sandwich including a hard foam core and two plates which surround the core. The upper plate has an upper rough surface for assisting the separation of the product particles into separate streams. The sorting boards are provided with an angular frame which surrounds the hard foam core and at the same time insures vertical distances between the individual rough surfaces of the sorting boards arranged in a stack and guarantees the product supply and the product withdrawal of the plates in an advantageous manner. The angular frame is provided at its supply side with an opening for the product to be assorted.

The separating and withdrawing unit of the inventive sorting machine can have three neighboring downwardly narrowing withdrawing shafts and above them, displaceable guiding sheets provided in the region of the sorting boards for supplying individual product fractions, as in the machine disclosed in the German document DE-OS 3,507,073. When the machine is designed in accordance with these known features, it is possible that despite respective repelling edges on the guiding sheets the injected grain can reach a neighboring withdrawing shaft in which it is not desired.

In accordance with a further advantageous and simple embodiment of the invention, further longitudinally adjustable guiding sheets are provided between the first mentioned guiding sheets and the separating edges of the withdrawing shafts, to follow the displacement of the guiding sheets. In accordance with a respective embodiment, the longitudinally adjustable further guiding sheets include a tongue and a double sheet which receives the tongue, wherein the tongue and the double sheet are turnably connected with a respective separating edge or the first mentioned guiding sheet associated therewith. In such a construction the above mentioned disadvantage is eliminated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
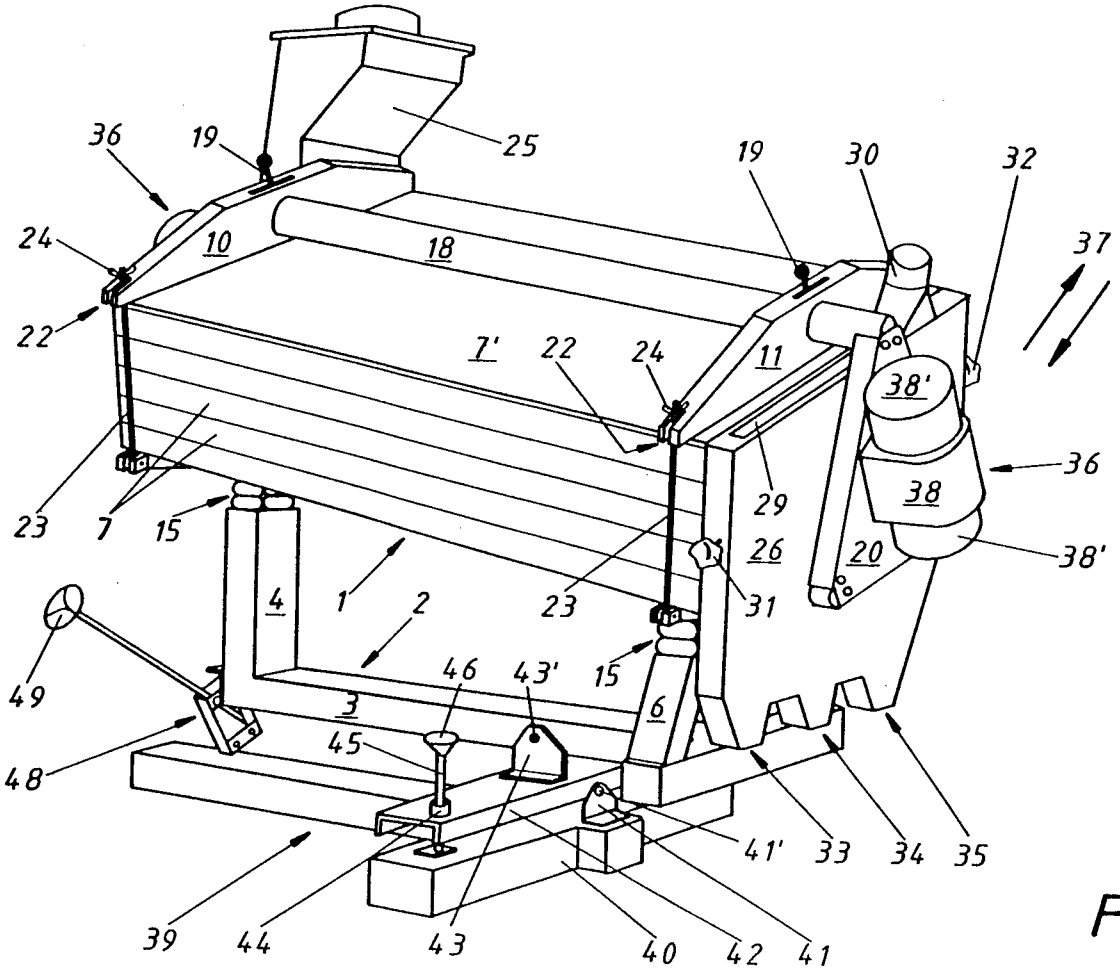
FIG. 1 is a forwardly inclined perspective view of a sorting machine for grained products in accordance with the present invention.
Figure 2:
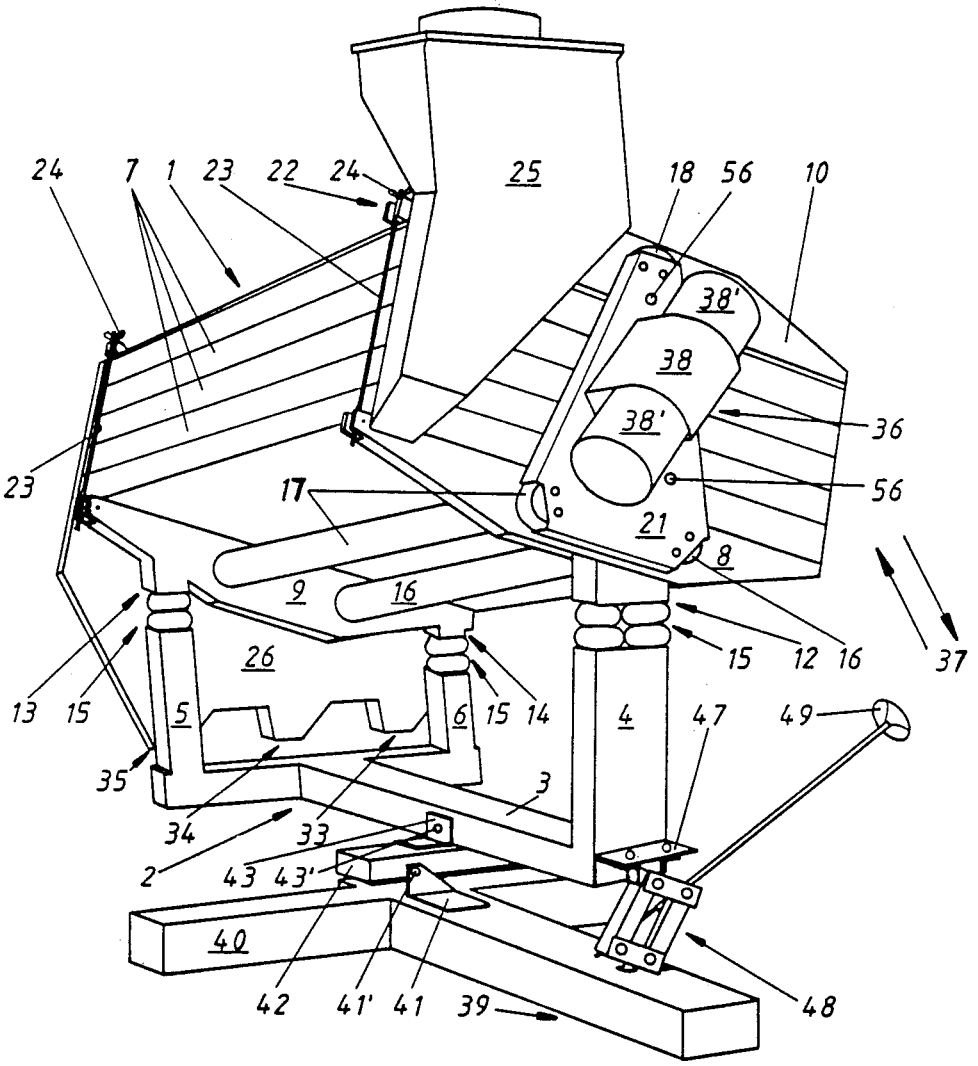
FIG. 2 is a rearwardly inclined view showing the sorting machine for the grained products of FIG. 1.

As can be seen from FIGS. 1 and 2, a sorting machine in accordance with the present invention includes a sorting unit 1 which is inclined spatially about two axes and positioned on a base frame 2. The base frame 2 is composed of a T-shaped member 3 and three supports 4, 5, 6 extending upwardly from it and having different lengths.

The code of the sorting unit 1 is several sorting boards 7 which are arranged one over the other. The sorting boards 7 are assembled or pressed relative to one another by two lower traverses 8 and 9 and two upper traverses 10 and 11. The uppermost sorting board is closed with a transparent plate 7' for sealing as well as for observation of the sorting process. The lower traverses 8 and 9 also have supporting points 12, 13, 14 for supporting on the supports 4, 5, 6 and the base frame 2. Vibration-damping elements 15 for example in the form of rubber spring elements are arranged between the supports and the supporting points. In the case of the support 4 or the supporting point 12, they are arranged for symmetry in pairs near one another.

The lower traverses 8 and 9 are welded on two stable, tubular, longitudinal supporting members 16 and 18 which extend somewhat outwardly over the traverses. The upper traverses 10 and 11 are arrestable on an upper, tubular, longitudinal supporting member 18 of the same length by a lever 19 by means of not shown eccentric unit. The three longitudinal supporting members 16, 17, 18 are connected by screws at their ends with a respective stable end plate 20 or 21 and thereby form a solid connection for receiving or arresting of the sorting unit 7 between the traverses 8, 9, 10, 11. In addition, the sorting boards are tensioned by tensioning rods 23 which are articulately connected at the ends of the lower traverses 8, 9 in a turnable manner and provided at their ends with respective recesses for the traverses 10, 11. Nuts 24 are screwed on the tensioning rods 23 for the above tensioning. This arrangement together with the releasability of the fixed connection between the upper, longitudinal supporting member 18 and the lower traverses 10, 11 by means of the lever 19 provide for an easy removal and exchange of the sorting boards 7. At the end sides, the sorting unit 1 is provided with a supplying device 25 for a product to be sorted on the one hand, and with a separating and withdrawing device 26 for withdrawing the individual product fractions from the sorting boards 7 and formed as an outlet. The supplying device 25 is arranged substantially in the region of the respective highest corner of the sorting boards and guarantees that all sorting boards 7 are supplied through their openings 27 shown in FIG. 3 at the same time and in a uniform manner with a product to be sorted.

Figure 3:
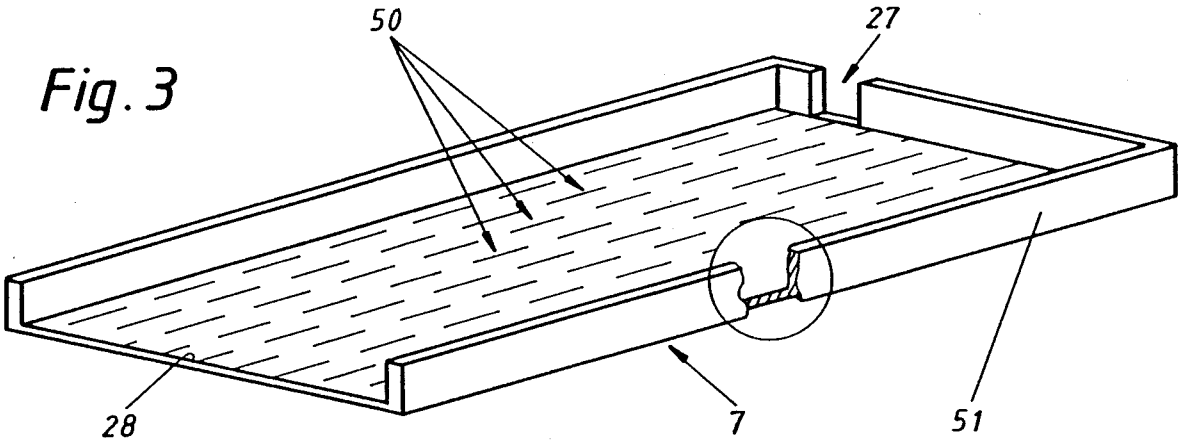
FIG. 3 is a view showing a sorting board of the sorting machine in accordance with the present invention.

The separating and withdrawing device 26 arranged at the deepest end of the sorting boards 1 receives the product in form of a partial stream which is formed on the sorting board 7 during the operation of the machine, over the edge 28 of the sorting board 7 shown in FIG. 3.

Figure 7:
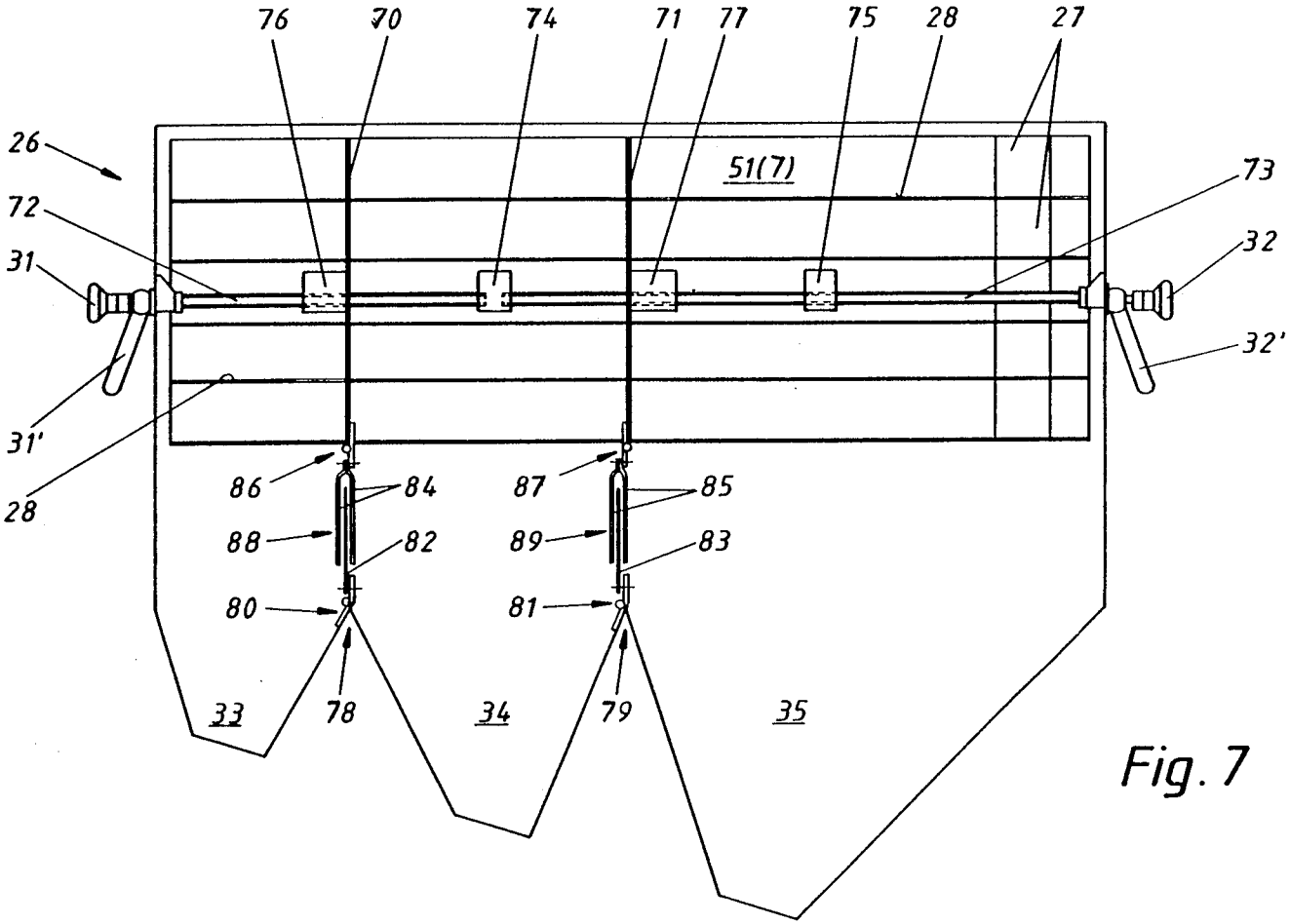
FIG. 7 is a simplified view of a separating and withdrawing unit of the inventive sorting machine, with a side wall removed.

The separating and withdrawing device is shown in detail in FIG. 7. It is mounted on the end plate 20 and is provided at the top with an inspection opening 26 and an aspiration pipe 30. For actuation of a guiding sheet adjustment shown in FIG. 7 and arranged inside the separating and withdrawing device 26, adjusting wheels 31 and 32 are provided, and the separating and withdrawing ends at the lower end in three withdrawing pipes 33, 34, 35. The whole sorting unit 1, including the supplying device 25 and the separating and withdrawing device 26 are subjected to reciprocating oscillations in the direction of the arrow 37 under the action of an imbalance (eccentric) drive 36 mounted on the end plates 20 and 21. The imbalance drives 36 are formed as so-called circular exciters which run in an opposite direction and synchronize so that the sorting unit 1 performs not a circular movement, but instead a reciprocating vibration. The vibration plane can be adjusted in a not shown manner for adjusting the imbalance drives so as to selectively change the position from the shown position to a different inclined position relative to the end plates 20, 21. In the schematically shown imbalance drives, a central part 38 is a motor while the imbalance weights proper are covered with caps 38'.

During the vibration of the sorting unit 1, the product which is supplied to the sorting boards 7 through the supplying device 25 travels from the supply openings 27 with formation of three partial streams in direction of the edges 28 of the sorting boards This subdivision in the sense of the size depends on the roughness of the sorting boards 7. The specific particles which are the heaviest or have the best sliding properties accumulate in the upper region of the edge 28 shown in FIG. 3 or in the withdrawing pipe 35, while the specific particles which are the lightest and have the worst sliding properties are concentrated in the lower region of the edge 28 and arrive through the separating and withdrawing device 26 in the withdrawing pipe 33. The mixed fraction is formed between both other fractions and withdrawn through the withdrawing pipe 34.

Since the spaced position of the sorting unit 1 provided by the differently high supports 4, 5, 6 of the base frame 2 can be not optimal for all materials to be sorted and for varying or correcting the sorting process during the operation, the position of the whole sorting unit 1 or the sorting boards 7 in space is changeable. For this purpose a bottom structure 39 is provided for the base frame 2. The bottom structure 39 is formed as a Cardan support. It is composed of a stationary base cross 40 and a traverse 42 which is supported in a bearing block 41 turnably about an axis 41' on the base cross 40. The traverse 42 turnably receives via a bearing block 43 the T-shaped member 3 of the base frame 2. An adjusting spindle 45 is guided on the traverse 42 in a welded threaded piece 44 and provided with a hand wheel 46. It is supported on the base cross 40 and utilized for turning the traverse 42 with the bearing block 43 as well as the base frame 2 with the whole sorting unit 1 about the axis 41'.

A further adjusting of the base frame 2 or the sorting unit 1 is provided about an axis 43' which extends perpendicularly to the axis 41'. It is performed by an adjusting device 48 which is formed as a shearing carriage lever supported between the base cross 40 and an angular sheet 47 mounted on the member 3 or the support 4. The adjusting device 44 has a hand wheel 49. As a result of this, the bottom structure 39 provides for the possibility of adjusting the sorting unit 1 in a space in all sides.

FIG. 3 shows one sorting board 7 on an increased scale and in a perspective view. It has a rough upper surface 50 formed by offset corrugations. In the region of the upper end of the sorting board 7, one can see an opening 27 in an angular frame 51 for supplying the product by means of the supplying device 25. There is no frame at the withdrawing side of the sorting board so that the product can flow over the whole width of the sorting deck over its edge 28 into the separating and withdrawing device 26.

Figure 3A:
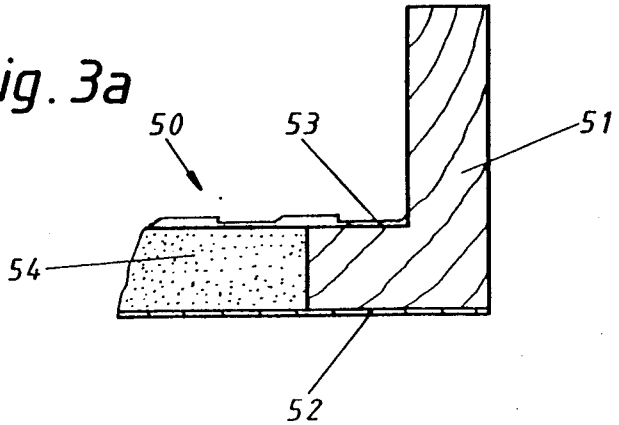
FIG. 3*a* is a view showing an edge region of the sorting board of FIG. 3, on an enlarged scale.

A fragment which is identified with a circle in FIG. 2 is shown in FIG. 3*a* on an enlarged scale for better illustration of the sorting board. The sorting board includes a bottom plate 52 and a top plate 53 with the above mentioned rough surface 50, as well as a hard foam core 54 for glueing both plates 52 and 53 with one another in a flat arrangement. The plates 52 and 53 are composed for example of aluminum for reducing the weight of the oscillating masses and engage in their end regions, with the exception of the withdrawing region formed by the edge 28, the angular frame 51 which is composed of wood and fixedly glued with them.

Figure 4:
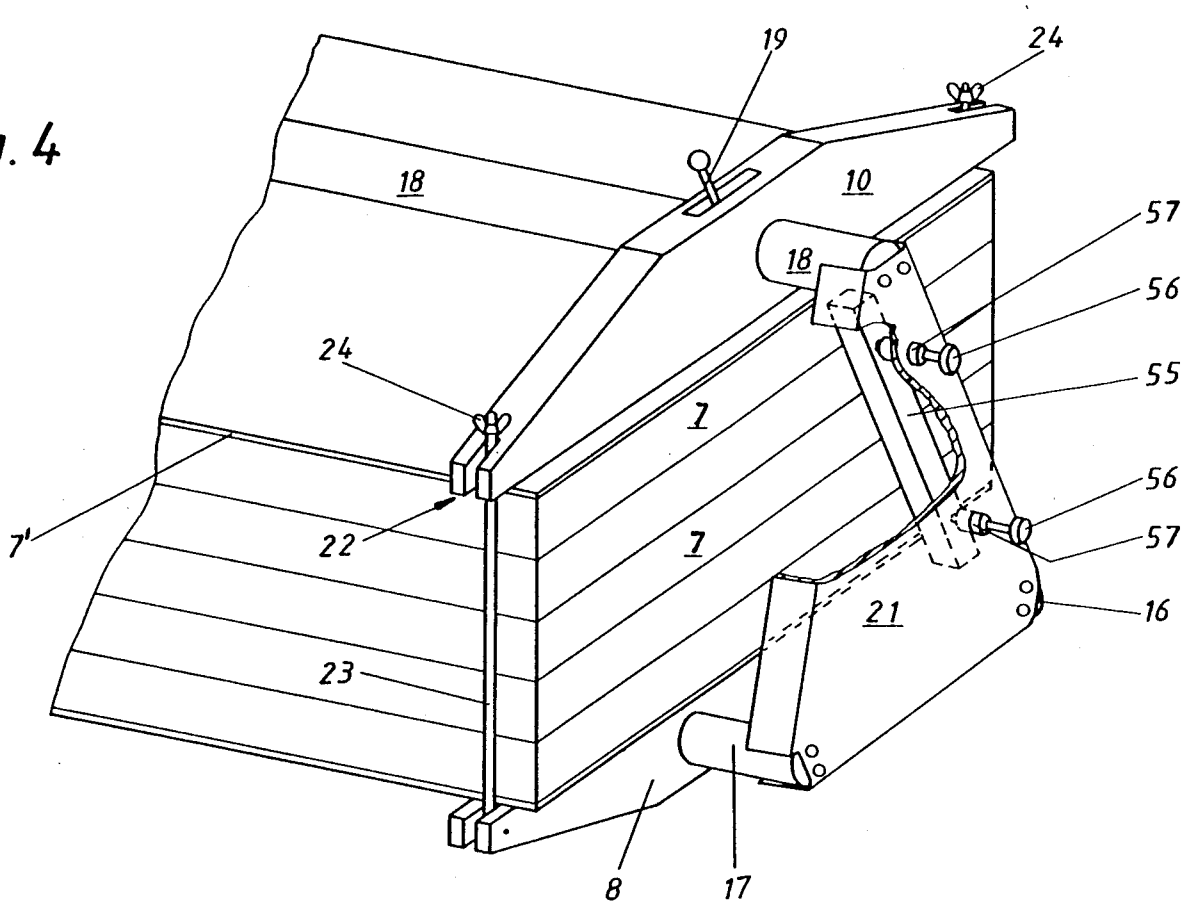
FIG. 4 is a partial perspective view of an end region of the machine with a pressing traverse.

In FIG. 4 the supplying device 25 and the imbalance drive 36 are removed. It shows a pressing traverse 55 extending over all sorting boards 7 inside or under the end plate 21. By means of adjusting screws 56 which are guided in threaded bushes 57 welded to the end plate 21, an adjustable pressure can be applied through the pressing traverse 55 on the sorting boards 7 which are very rigid because of their construction. This guarantees a reliable tight abutment of all sorting boards 7 against the separating and withdrawing device 26.

Figure 5:
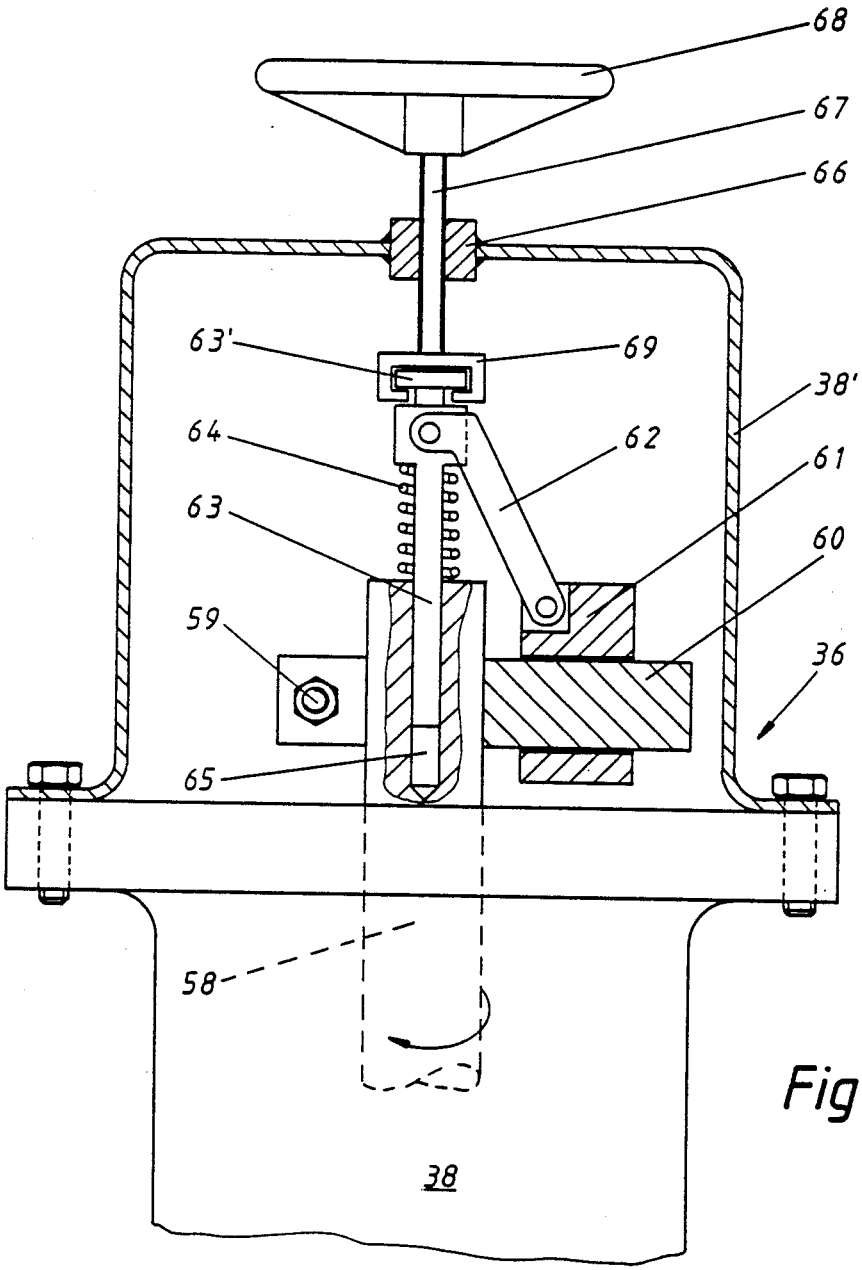
FIG. 5 is a view showing a portion of an imlabance drive with a manually radially displacable imbalance weight of the inventive machine.

FIG. 5 shows the upper part of one of the imbalance drives 36, partially in section. It has the central part 38 which contains a motor shaft 58, while the lower part of the imbalance drive which exactly corresponds to the upper part is not shown in the drawing. The cap 38' accommodates an imbalance weight 60 which is fixed on the motor shaft 58 by a screw 59 and serves simultaneously as a guiding rail for further displacelable imbalance weight 61. The imbalance weight 61 is articulately connected via a hinge lever 62 with a guiding rod 63 which is guided against the force of spring 64 in a vertically displaceable manner in a respective opening 65 of the drive shaft 58. It can be seen that during this height displacement the displaceable imbalance weight 61 moves on the imbalance weight 60 so that depending on the selected adjustment of the mass center point of the total weight, both imbalance weights are concentrated more or less farther in a radial direction from the motor shaft 58. A manual adjustment is provided by a hand wheel 68 through an adjusting spindle 67 which is guided in a threaded bush 66 on cap 38'. A receptacle 69 surrounds a respectively shaped head 63' of the guiding rod 63 formed at the end of the adjusting spindle 67.

Figure 5A:
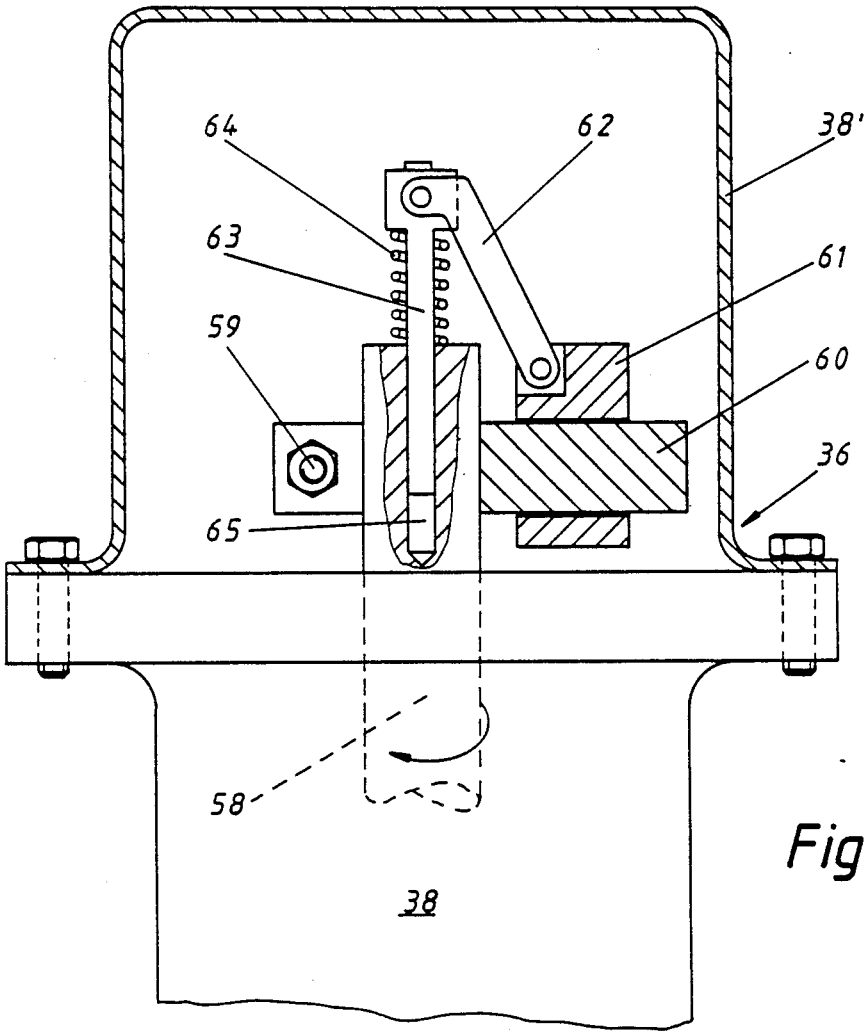
FIG. 5*a* is a view showing a part of an imbalance drive with an automatically radially displaceable imbalance weight of the inventive machine.

In FIG. 5*a* the adjusting spindle together with the spindle bush, the hand wheel and the receptacle are not shown and the remaining structure is the same as in FIG. 5, so that in the event of a change in the number of revolutions of the motor shaft 58 the imbalance weight 61 displaces on the imbalance weight 60 which is fixedly connected with the motor shaft 58. With an increase in the number of revolutions of the motor shaft 58 the imbalance weight 61 under the action of the centrifugal force moves outwardly against the force of the spring 64 so that an increased radial distance of the mass center point of the total weight from the motor shaft 58 is effected. With respect to the sorting unit 1 it leads to an increase of the stroke. Contrary to this, with a decrease of the number of revolutions, the spring 64 because of its expansion behavior leads to a reduction of the deviation distance of the imbalance weight 61 and thereby to a reduction of the stroke. It is to be understood that the functions of the spring 64 can be performed also for one or several weights in accordance with the principle of a regulation in a steam machine.

Figure 6:
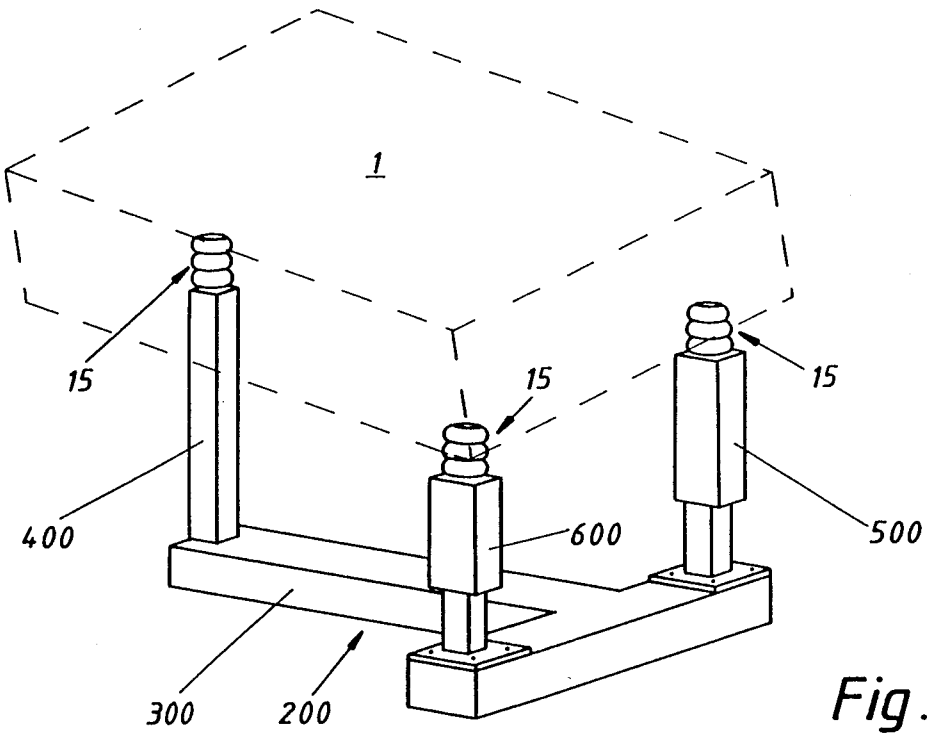
FIG. 6 is a view showing a further embodiment of a base frame of the sorting machine in accordance with the present invention.

FIG. 6 shows how the sorting unit 1 shown in a broken line is supported on a frame which carries the sorting unit 1 and provides its adjustment with spatial inclinations, in accordance with one embodiment of the invention. Instead of the combination of the base frame 2 and its bottom structure 39 shown in FIGS. 1 and 2, here only one single base frame 200 is provided It resembles the base frame 2 and comparing to the base cross 40 lies directly on the ground. Instead of the supports 4, 5, 6 which extend in direction of the support points 12, 13, 14, with a fixed length, the structure in FIG. 6 has supports 400, 500, 600 of which at least two are adjustable in their lengths. For example, the supports 500 and 600 located in the region of the separating are withdrawing device 26 can be adjustable. It is of course possible to make the support 400 and one of the remaining supports 500 or 600 in a length-adjustable manner. In all cases, the extension and retraction of the support provides for any desired position of the sorting unit 1 in space in a simple manner. The universal solution is to form all support lengths adjustable.

For executing the length adjustment, electromechanical, hydraulic or pneumatic adjusting elements can be taken into consideration, which are conventional and simple to handle. It can be recommended for respective positions of the sorting unit which are suitable for certain products to be sorted, to supply the height coordinates to the supporting points 12, 13, 14 relative to the ground electronically, and if necessary, to evaluate respective adjusting commands for the adjustable supports. Also, fast or slow adjustment of the sorting unit in a stepless manner or in small steps is possible both relative to a horizontal plane and relative to a vertical plane, as well as simultaneously in both planes.

FIG. 7 shows the basic structure of the separating and withdrawing device 26 with the exception, for example of the inspection opening 29 and the aspiration pipe 30, as well as the side wall located under the end plate 20. It can be seen that the supply side of the sorting machine behind the separating and withdrawing device 26 and the openings 27 in the angular frame 51 of the sorting boards 7 are provided The sorting boards 7 have the edges 28 which are located before the separating and withdrawing device 26 and over which the product is supplied to this device.

Two guiding sheets 70 and 71 are arranged perpendicularly to the edge 28 and are adjustable by means of threaded spindles 72 and 73 with hand wheels 31 and 32. They separate the withdrawing regions which lie above the withdrawing pipes 33, 34 and 35. The threaded spindles 72 and 73 are guided at their ends in a stationary bearing block 74. The threaded spindle 73 has a greater length and therefore provides additional guidance for the immovable threaded block 75. The adjusting movement is transferred to the guiding sheets 70, 71 through threaded blocks 76, 77 mounted on them. The blocks are moved by the spindles 72, 73. After the end of the adjustment, the threaded spindles 72, 73 and thereby the guiding sheets 70, 71 are arrested by means of clamping levers 31', 32'.

Due to the nature of the sorting principle which has been changed with the inventive sorting machine, the width of the withdrawing regions of the free product fractions above the withdrawing pipes 33, 34, 35 can be significantly varied, so that the guiding sheets 70, 71 must be adjusted relatively frequently and in relatively wide regions with respect to the separating edges 78, 79 located in the figure perpendicularly under them between the withdrawing shafts. There is here the disadvantage that the ejected grain can flow from a withdrawing region not to the predetermined withdrawing pipe, but instead into the neighboring pipe. This can lead to a worsening of the sorting results and therefore is undesirable.

For completely preventing this negative effect, upwardly directed tongues 82 and 83 are arranged above the separating edges 78 and 79 and mounted on hinges 80 and 81.

Similarly to the guiding sheets 70 and 71, they extend over the whole depth of the separating and withdrawing device 26. The tongues 82 and 83 in turn are received in double sheets 84, 85 which are mounted by means of hinges 86 and 87 on the lower edges of the guiding sheets 70 and 71. Thereby the tongues 82 and 83 are movably guided between the double sheets 84 and 85 and form so to say longitudinally adjustable guiding sheets 88 and 89. During an adjustment of the guiding sheets 70 and 71, the double sheets 84 and 85 move together with them, whereby they reach in part considerably inclined positions in which they slidingly follow the tongues 82 and 83. Because of this construction, in each adjusting position of the guiding sheets 70 and 71 an absolutely thorough separation of the product fractions in the three regions is insured by the guiding sheets 70 and 71.

It will be understood that each of the elements described above, or two or more together, may also find a useful application in other types of constructions differing from the types described above.

While the invention has been illustrated and described as embodied in a sorting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A sorting machine for grained products, comprising at least one sorting board which is inclined relative to horizontal and vertical planes and reciprocatingly vibratable in a plane and direction suitable for sorting; means for supplying a product to be sorted and arranged in one region of said sorting board; means for separating and withdrawing a sorted product and located in another region of said sorting board, said sorting board with said supplying means and said separating and withdrawing means together forming a sorting unit; two imbalance drives which operate in opposite directions and cooperate with said sorting unit for driving the latter in vibration; a base frame; means forming at least three supporting points on which said sorting unit is supported in a vibration-damping manner freely movably so as to provide inclination of said sorting unit relative to horizontal and vertical planes; and means for additionally adjusting said inclination relative to the horizontal and vertical planes; at least one second such sorting board, each of said sorting boards having one edge located in one of said regions and another edge located in the other of said regions, said sorting boards being arranged one over the other in form of a stack; means for connecting said sorting boards with one another and including an upper traverse and a lower traverse located near each of said edges so that said sorting boards are located between said upper traverses and said lower traverses, and releasable clamping elements connecting each of said upper traverses with a respective one of said lower traverses, said supporting points being arranged in said lower traverses; and at least one lower elongated supporting member fixedly connecting said lower traverses with one another.

2. A sorting machine as defined in claim 1; and further comprising at least one upper elongated supporting member which extends substantially parallel to said lower elongated supporting member centrally of said upper traverses so that said upper traverses are supported and fixable on said upper elongated supporting member.

3. A sorting machine as defined in claim 2, wherein all said elongated supporting members extend laterally beyond said traverses and also laterally beyond said separating and withdrawing means and have ends which are connected with one another; and further comprising two end plates each connecting one end of all said elongated supporting members with one another.

4. A sorting machine as defined in claim 3, wherein each of said imbalance drives is arranged on a respective one of said end plates.

5. A sorting machine as defined in claim 3; and further comprising a pressing traverse which is supported adjustably against one of said end plates located in the region of said supplying means and engaging all said sorting boards, said pressing traverse acting in direction toward said separating and withdrawing means.

6. A sorting machine for grained products, comprising at least one sorting board which is inclined relative to horizontal and vertical planes and reciprocatingly vibratable in a plane and direction suitable for sorting; means for supplying a product to be sorted and arranged in one region of said sorting board; means for separating and withdrawing a sorted product and located in another region of said sorting board, said sorting board with said supplying means and said separating and withdrawing means together forming a sorting unit; two imbalance drives which operate in opposite directions and cooperate with said sorting unit for driving the latter in vibration; a base frame; means forming at least three supporting points on which said sorting unit is supported in a vibration-damping manner freely movably so as to provide inclination of said sorting unit relative to horizontal and vertical planes; and means for additionally adjusting said inclination relative to the horizontal and vertical planes, said base frame including a horizontal, substantially T-shaped member having a plurality of ends and provided at said ends with supports which extend in direction toward said supporting points and have different lengths; and a bottom structure which supports said base frame, said base frame being adjustable in horizontal and vertical planes, said bottom structure being formed as a Cardan support.

7. A sorting machine as defined in claim 6, wherein said base frame is provided with three such supports extending from said horizontal substantially T-shaped member.

8. A sorting machine for grained products, comprising at least one sorting board which is inclined relative to horizontal and vertical planes and reciprocatingly vibratable in a plane and direction suitable for sorting; means for supplying a product to be sorted and arranged in open region of said sorting board; means for separating and withdrawing a sorted product and located in another region of said sorting board, said sorting board with said supplying means and said separating and withdrawing means together forming a sorting unit; two imbalance drives which operate in opposite directions and cooperate with said sorting unit for driving the latter in vibration; a base frame, said base frame including a horizontal substantially T-shaped member having a plurality of ends and provided in the region of said ends with supports, at least two of said supports being adjustable in the direction of their length; means forming at least three supporting points on which said sorting unit is supported in a vibration-damping manner freely movable so as to provide inclination of said sorting unit relative to horizontal and vertical planes, said supports extending in a direction toward said supporting points; and means for additionally adjusting said inclination relative to the horizontal and vertical planes.

9. A sorting machine as defined in claim 8, wherein said base frame is provided with three such supports extending from said horizontal substantially T-shaped member.

10. A sorting machine for grained products, comprising at least one sorting board which is inclined relative to horizontal and vertical planes and reciprocatingly vibratable in a plane and direction suitable for sorting; means for supplying a product to be sorted and arranged in one region of said sorting board; means for separating and withdrawing a sorted product and located in another region of said sorting board, said sorting board with said supplying means and said separating and withdrawing means together forming a sorting unit, said separating and withdrawing means including at least three adjacent downwardly narrowing withdrawing shafts and displaceable guiding sheets located above said withdrawing shafts in the region of said sorting board for supplying individual product fractions of a sorted product, said withdrawing shafts having separating edges; two imbalance drives which operate in opposite directions and cooperate with said sorting unit for driving the latter in vibration; a base frame; means forming at least three supporting points on which said sorting unit is supported in a vibration-damping manner freely movably so as to provide inclination of said sorting unit relative to horizontal and vertical planes; and means for additionally adjusting said inclination relative to the horizontal and vertical planes; and longitudinally changeable further guiding sheets which are located between said first mentioned guiding sheets and said separating edges of said withdrawing shafts for and adjusted simultaneously with said first mentioned guiding sheets.

11. A sorting machine as defined in claim 10, wherein each of said longitudinally changeable guiding sheets includes a tongue and a double sheet which receives said tongue, said tongue and said double sheet being arranged in a turnable manner.

12. A sorting machine as defined in claim 11, wherein said tongue and said double sheet being turnably connected with a respective one of said separating edges of said withdrawing shafts.

13. A sorting machine as defined in claim 11, wherein said tongue and said double sheet being turnably connected with a respective one of said first mentioned guiding sheets.

* * * * *